United States Patent [19]

Hoofe, III

[11] Patent Number: 4,476,661

[45] Date of Patent: Oct. 16, 1984

[54] CLIP LOCKED ROOFING AND SIDING PANELS

[76] Inventor: William J. Hoofe, III, 1973 Port Provence, Newport Beach, Calif. 92660

[21] Appl. No.: 330,193

[22] Filed: Dec. 14, 1981

[51] Int. Cl.[3] ..... E04D 1/34

[52] U.S. Cl. ..... 52/546; 52/547

[58] Field of Search ..... 52/520, 545, 546, 547, 52/548, 552, 543

[56] References Cited

U.S. PATENT DOCUMENTS

| | | | |
|---|---|---|---|
| 2,206,201 | 7/1940 | Plym | 52/547 X |
| 2,317,015 | 4/1943 | Allen | 52/547 X |
| 3,302,357 | 2/1967 | Scott | 52/547 X |
| 3,738,076 | 6/1973 | Kessler | 52/547 |
| 4,015,391 | 4/1977 | Epstein et al. | 52/555 X |
| 4,251,967 | 2/1981 | Hoofe | 52/555 X |

*Primary Examiner*—Carl D. Friedman

*Attorney, Agent, or Firm*—Blakely, Sokoloff, Taylor & Zafman

[57] ABSTRACT

An improved simulated tile roofing panel is disclosed. The panel comprises a background sheet of relatively thin material, such as ABS in which are integrally formed one or more raised elongated tile segments, disposed in a substantially parallel spaced relationship. Each decorative element are formed for cooperative engagement with a clip member for securing the front edge of one panel to the rear edge of an adjacent panel. Alternate embodiments of the clip member and of the form of the ends of the decorative element are disclosed.

26 Claims, 11 Drawing Figures

CLIP LOCKED ROOFING AND SIDING PANELS

PRIOR ART STATEMENT

Applicant submits this prior art statement concurrently with the filing of the accompanying patent application entitled CLIP LOCKED ROOFING PANELS in conformance with Rules 1.97 and 1.98, together with a copy of each item of prior art discussed. These references, in applicant's opinion, constitute the most pertinent references known to applicant.

| U.S. Pat. No. | Patentee | Year of Issue |
|---|---|---|
| 4,251,967 | William J. Hoofe, III | 1981 |
| 4,015,391 | Epstein et al. | 1977 |

Epstein shows simulated shake shingle panels which are formed at their front and rear edges to interfit and secure the front edge of one panel to the rear edge of an adjacent panel. Epstein's panels show two courses of shingles on a single panel (see FIGS. 4,5 and 10). The front edge of a panel is provided with a continuous channel 22 formed at the rear edge of an adjacent panel. The wall 23 which forms a part of channel 22 also forms a part of the visable surface of a particular shake decorative element 21 (FIG. 3).

Hoofe III discloses a simulated tile roofing panel having a background sheet of relatively thin material in which are integrally formed one or more raised elongated tile segments, disposed in a substantially parallel spaced relationship. The respective ends of the tile segments are formed with cooperating portions so that the front ends of the tiles on one panel will interlock with rear ends of the tile segments on an adjacent panel. The interlocking portions are best illustrated in FIGS. 2 and 6.

SUMMARY OF THE INVENTION

A light weight roofing panel is disclosed having raised decorative elements thereon, portions of which cooperate with a clip which interlocks adjacent panels together. Preferably the panels are formed of sheets of relatively thin material, such as ABS.

The invention comprises, in general, (i) a substantially planar background sheet member, (ii) decorative elements formed on the sheet member and raised with respect thereto, and (iii) a clip for interlocking adjacent front and back ends of adjacent panels.

DETAILED DESCRIPTION OF THE INVENTION

The present invention comprises a roofing and siding panel with raised, decorative patterns thereon. The panels may be applied to a roof or siding to form a substantially watertight covering. While the decorative pattern illustrated in the Figures simulates a Spanish tile design, it is to be understood that other decorative patterns could as well be used, as the present invention is applicable to the simulation of any roofing or siding covering characterized by individual elements set on the roof or siding in spaced apart and/or overlapping disposition.

The preferred embodiment is fabricated from a substantially rigid material such as ABS (acrylonitrile-butadiene-styrene), or weather resistent PVC (polyvinyl-chloride) though other plastic materials or metals will also be found suitable. The panels may be of a colored material, coated with a protective colored laminate or painted or otherwise treated to closely simulate the appearance of tile, shake or other products as desired. The panels are preferably fabricated from sheets of thermoplastic material utilizing vacuum forming techniques, though alternative manufacturing processes, including injection molding, foam molding and the like may also be used. Thus, the preferred embodiment comprises an integral, one-piece panel of relatively thin rigid material, the sheet material being forced by the combination of pressure and/or vacuum and heat to assume the contours of the mold. Of course a roofing or siding panel could be constructed of discrete elements similar in nature to the decorative elements described herein and in accordance with the spirit of the invention.

Figure 1:
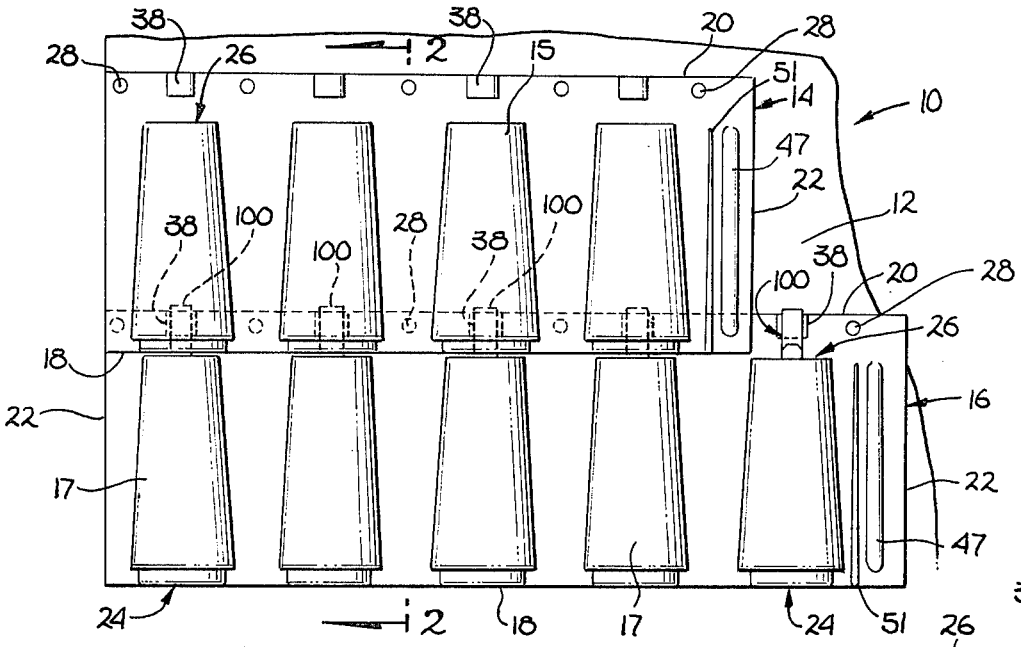
FIG. 1 is a top plan view of a portion of a roof covered with the interlocking panels and clip of the subject invention.
Figure 2:
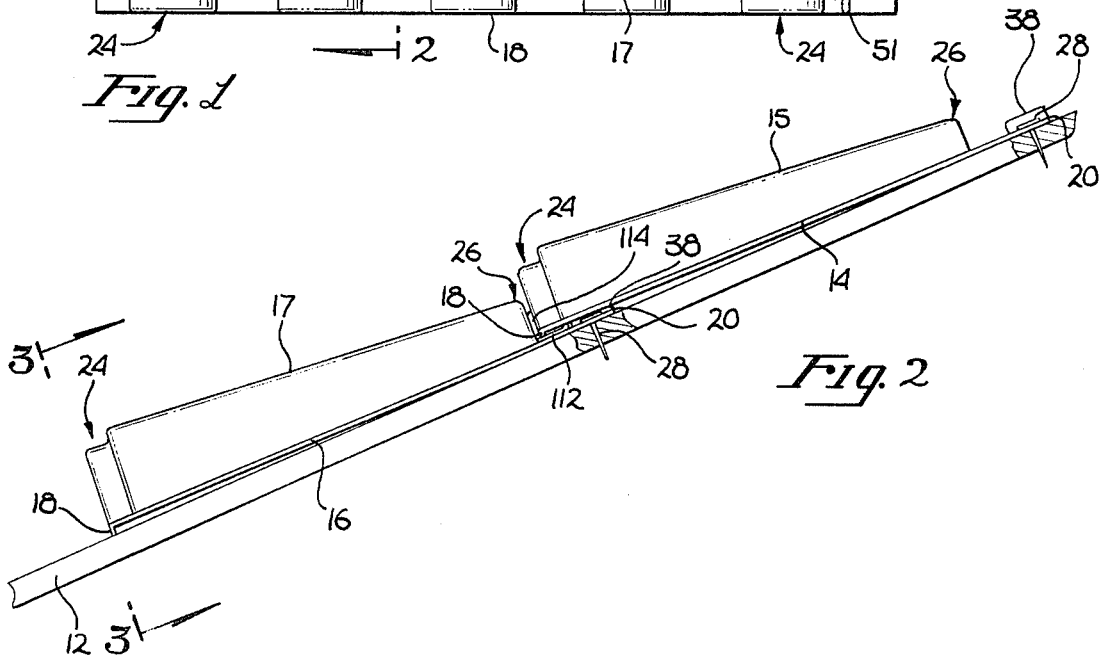
FIG. 2 is a side elevational view of the decorative element taken along line 2—2 of FIG. 1.
Figure 3:
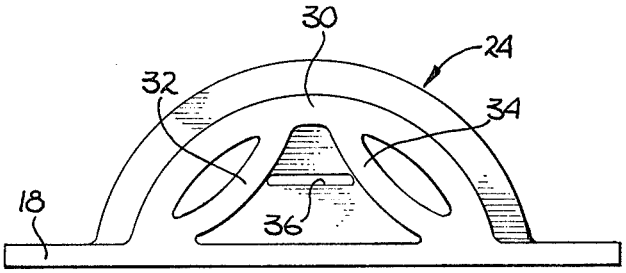
FIG. 3 is a front elevational view of the front end of the decorative elements taken along the line 3—3 of FIG. 2.
Figure 4:
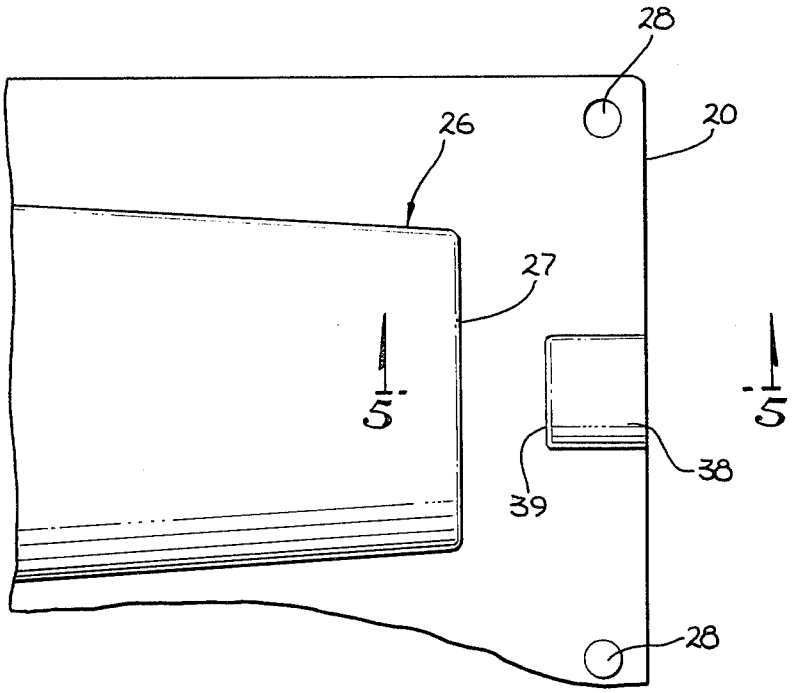
FIG. 4 is a top plan view of the back end of the decorative element.
Figure 5:
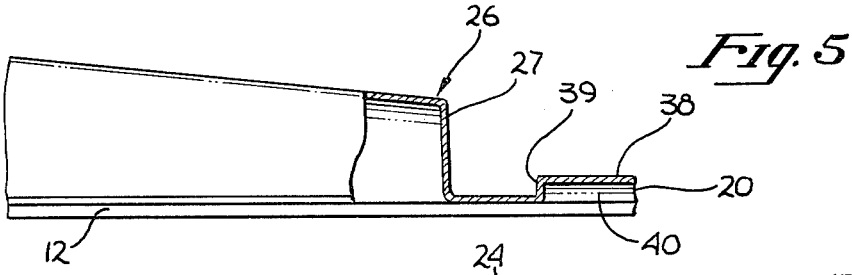
FIG. 5 is a cross sectional view taken along the line 5—5 of FIG. 4.

Referring now to FIGS. 1 and 2 the preferred embodiment is illustrated. FIG. 1 illustrates a section 10 of roof 12 covered with the subject panels, panel 14 and panel 16 each having a plurality of decorative elements 15 and 17 respectively formed thereon. Each panel comprises a background sheet member 22 from which the decorative elements extend in relief. Panel 14 is shown with four decorative elements 15 and panel 16 is shown with five decorative elements 17, both of a single course. Of course, any convenient number of decorative elements and/or courses can be used, depending on the size of each decorative element and the length or width of panel most convenient for handling by an installer. Other than the number of decorative elements provided, panels 14 and 16 are identical, and the decorative elements 15 and 17 are also identical. Each panel has a front end 18, a rear edge 20 and two side edges 22 and 23. Channel 51 is formed in the background sheet member 22 substantially parallel to side edge 23 of the panel 16, and extends from the front edge to the rear edge of the panel. The front edge of the panel is elevated with respect to the rear edge by the depth of lip member 18*a*, the depth of the channel 51 accordingly progressively decreasing from front to rear. Channel 51 is appropriately placed to receive the side edge with wedge shaped lip of an adjacent installed panel, thereby interlocking the adjacent side edges. Also extending upward from the background sheet member 22 between channel 51 and side edge 23 is an elongated protrusion 47, terminating just short of the forward edge 18 of the panel and just before the forward lip 18*a* of the next adjacent upper panel in roof installations. When a course of panels is installed, protrusion 47 is disposed beneath a tile member of the adjacent panel, and serves as a dam against water seepage beneath the edge of the panel 16. Similarly each decorative element 15 and 17 has a closed front end 24 and a substantially closed back end 26. Normally all panels would have the same number of decorative elements though they would preferably be installed with successive courses being staggered and panels cut at the roof edge accordingly. Thus panel 14 would be identical to panel 16 but cut at the left edge of the roof so that the right edge of each of the panels in the two courses would be staggered.

Roofing panel 14 abuts panel 16 as it is laid upon a roof 12 in successive courses, as shown in FIG. 2. The lower course, i.e. panel 16, is positioned on roof 12 and secured in position as by nails 28 (or staples) driven through the panel near its rear edge 20. The upper course, i.e. panel 14, is positioned on roof 12 and secured in position as by nails 28 driven through the panel near its rear edge 20. The upper course, i.e., panel 14 is positioned with its front edge 18 abutting the rear end 26 of the decorative elements 17 on the lower panel 16. Thus upper course 14 overlaps and conceals the rear edge 20 of the lower panel 16 and the nails 28.

Figure 6:
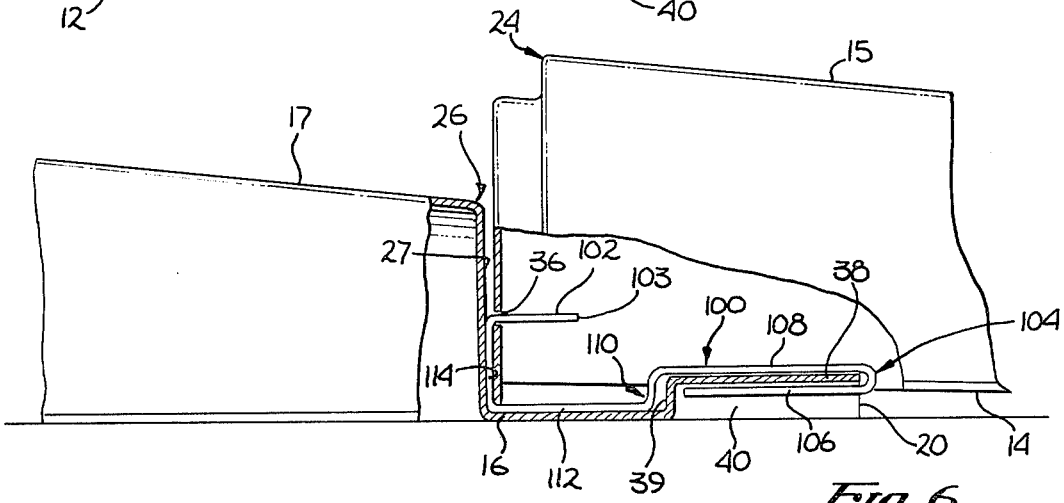
FIG. 6 illustrates the interlocking couples of two adjacent panels utilizing a clip.

As shown in FIGS. 3 through 6, the rear edge 20 of a panel and the front end 24 of each decorative element (15 or 17) are formed to cooperate with a clip (e.g. 100) to secure the two panels 14 and 16 together. The front end 24 of a decorative element (15 or 17) is provided with decorative contours 30, 32 and 34 and a slot 36 for receiving a locking tab 102 of a clip 100. The rear end 26 of a decorative element (15 or 17) is located adjacent the rear edge 20. Spaced along edge 20 and proximate each rear end 26 are a plurality of raised areas 38 each having a forward most wall 39. When the panel 14 or 16 is placed on a roof 12, the raised area 38 together with the upper flat surface of the roof 12 defines a pocket 40. Pocket 40 and slot 36 cooperate with opposite ends of clip 100 as shown in FIG. 6 to secure the panels 14 and 16 in place such that a front end portion 24 is restrained from lifting off the roof even when subjected to high wind.

The cooperation of clip 100 with slot 36 and pocket 40 is best illustrated in FIG. 6. A clip 100 as shown in FIG. 6 preferably comprises a formed or molded plastic member of the same color and material as the plastic panels though also may be a piece of extrusion or a flat rectangular bar of metal, bent to form a U-shaped section 104 at one end, having a free arm 106 and a joined arm 108. The joined arm is connected to the step portion 110. Base member 112 joins step 110 with riser arm 114 at the free end of which is provided a tab member 102. The separation between the arms 106 and 108 of U-shaped section 104 is slightly less than, or substantially equal to, the thickness of the raised area 38. The raised area 38 is raised above the plane of the panel (14 or 16) by a distance substantially equal to the thickness of the sheet of material from which the panel is made. Also, the thickness of the clip 100 is substantially the same as the thickness of the sheet of material which forms the panel. Thus, the pocket 40 is just thick enough to receive arm 106 when the U-shaped section 104 is clipped over raised area 38.

When the U-shaped section 104 is clipped over the raised area 38 and slid toward forward wall 39, step 110 snaps in position forward of wall 39. The length of base member 112 is approximately equal to the distance from forward wall 39 to the rear wall 27 of a decorative element (15 or 17) such that riser arm 114 abuts the rear wall. Tab 102 projects rearwardly at substantially a right angle from the top of riser arm 114 and is tapered to have its rearward most edge 103 somewhat narrrower than slot 36 to facilitate insertion of the tab 102 into the slot 36 during installation. When a panel 14 is joined at its forward edge 18 to a panel 16 at its rearward edge 20 by the clip 100 as shown in FIG. 6, the downward and rearward slope of tab 102 projecting through slot 36 secures the front edge 18 from rising even in a strong wind.

It should be noted that although a slot 36 has been provided in the front end 24 of each decorative element, any rain, snow, or wind driven moisture which makes its way through the slot 36 would soon fall onto the underlying upper surface of the next lower course panel. The moisture would still be a fair distance below the rear edge 20 which it would have to flow over in order to reach the underlying roof covering, typically an asphalt saturated felt, waterproof in itself. The moisture would drain downward and flow under the front edge 18 of a panel through the gap, between the front edge 18 and the panel therebeneath. The presence of slot 36 thus does not result in any leakage of moisture to the underlying roof surface.

Installation of the panels begins by laying a starter course of panels on the lower edge of a roof 12. The rear edge 20 of a given panel is secured to the roof by a plurality of nails 28 driven through the panel and into the roof. The nails are placed near the rear edge 20 so that the placement of the next upper course of panels will overlap and conceal the nails. The front edge 18 of the starter course of panels may be secured to the roof by nailing.

After the first course has been secured in position, one clip 100 is positioned with its U-shaped section 104 clipped over the raised area 38 located proximate each decorative element 17. The clip 100 is pushed toward the front edge 18 of the lower course panel until the step 110 is past the rear wall 39 of the raised area, and riser member 114 abuts the rear wall 27 of a decorative element 17.

When all the clips 100 have been placed in position on the lower course of panels, the next upper course of panels may be placed in position. A panel 14 is positioned such that its rear edge 20 is elevated far above its front edge 18 and its slots 36 are proximate the tabs 102 of the clips 100 previously positioned. The panel to be installed is adjusted such that the tabs 102 each project through a slot 36. The positioning and alignment of the slots 36 with the tabs 102 is facilitated by the fact that the slot 36 is wider than the rearward most edge 103 of the tab 102. When the tabs 102 and slots 36 are properly aligned, the panel and slot are pushed forward (i.e. the slot 36 is pushed toward the riser 114) causing the tab 102 to become properly inserted into slot 36. The rear edge 20 is then lowered to the roof 12 and similarly nailed to the roof at its rear edge 20. Additional panels are similarly installed to complete the second course of panels and the remainder of the roof.

Figure 7:
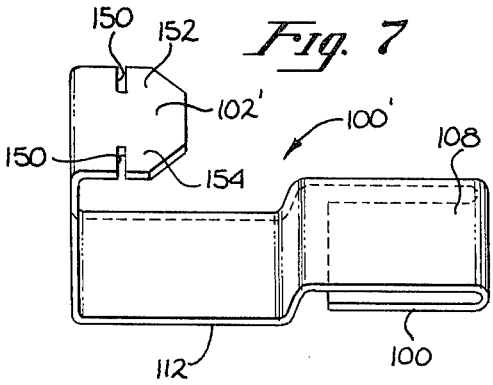
FIG. 7 is a top plan view of the clip of one embodiment of the invention.
Figure 8:
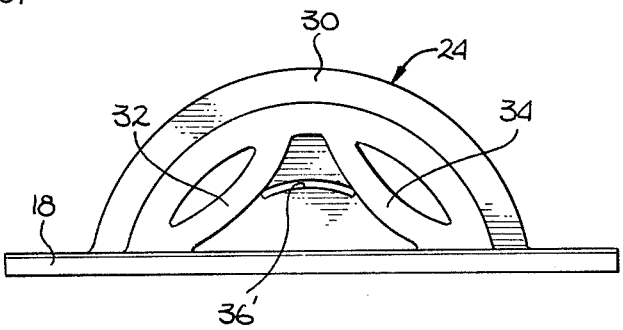
FIG. 8 is an alternate embodiment of the front end of the decorative element.
Figure 11:
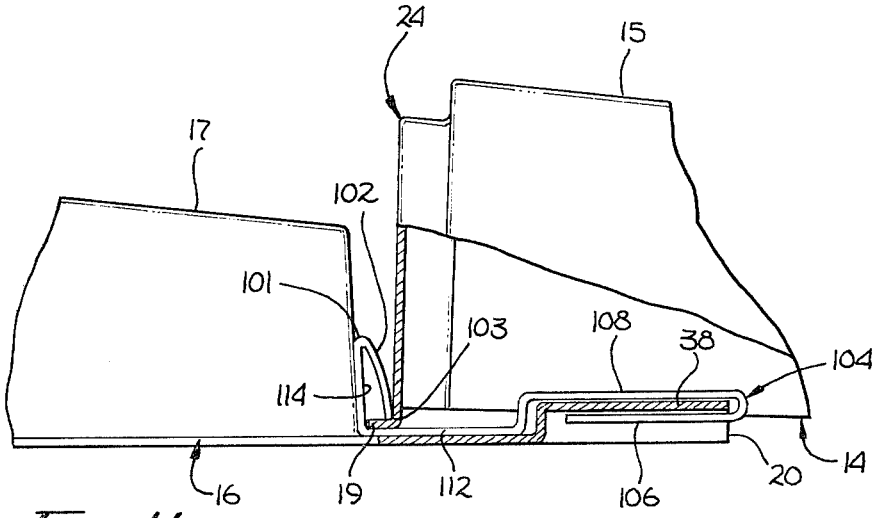
FIG. 11 shows an alternate form of clip and alternate form of front end of the decorative element.

An alternate configuration of slot 36 and tab 102 is illustrated in FIGS. 7 and 8. Clip 100' is provided with a tab 102' having a pair of transverse slots 150 defining a first side wing 152 and a second side wing 154. This particular configuration of tab 102' is intended to cooperate with an arcuate slot 36' shown in FIG. 8. The presence of slots 150 allows side wings 152 and 154 to be sufficiently flexible that they can easily bend (as the rearward edge 103' passes through slot 36') to conform to the curvature of slot 36' and thus permit the tab 102' to completely pass through the arcuate slot 36'. When the tab 102' passes through slot 36' to where the slots 150 reach the plane of slot 36', the side wings 152 and 154 will spring back to their straight position (i.e. co planar with the rest of tab 102') and thus lock the tab 102' into arcuate slot 36'.

Of course, the same locking principle can be effected by making the side wings bent in their unstressed state and using a straight slot 36. As the bent side wings pass through the straight slot they would be straightened and thus capable of passing through the slot. As the slots 150 reached the plane of straight slot 36 the side wings would return to their bent state and lock the tab 102 into the straight slot 36.

Figure 10:
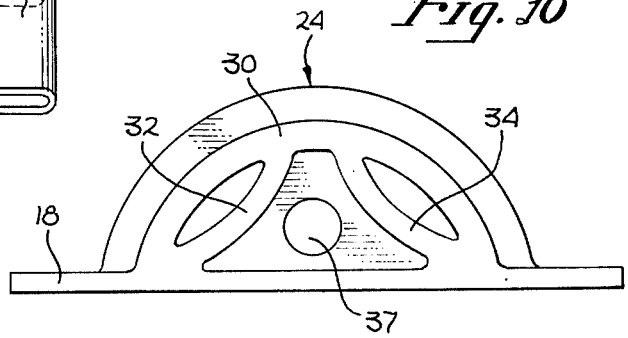
FIG. 10 is a further alternate embodiment of the front end of the decorative element.
Figure 9:
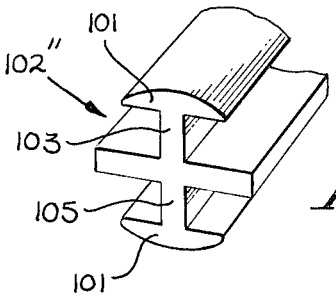
FIG. 9 shows an alternate form of a clip tab.

A further alternate configuration of slot 36 and tab 102 is illustrated in FIGS. 9 and 10. Here the clip is provided with a tab 102" resembling an elongated cross. Each arm of the crossshaped tab is equidistant from the center. The ends 101 of arms 103 and 105 of the cross shaped tab 102" are curved to increase the area of engagement, and may be notched to provide an interlock when tab 102" is passed through a corresponding round slot 37 in the front of the panel of the next course. The leading end of the tab, of course, is tapered for ease of alignment and entry of the tab into the next panel.

The two panels 16 and 14, or any lower course panel and an upper course panel, may also be secured to one another by the clip 100" and tab 102 without the use of a slot 36. Such a configuration is shown in FIG. 12. The decorative element 15 of the upper panel 14 does not have a slot 36. The clip 100" has substantially the same configuration as clip 100 of FIG. 7 except that the tab 102 has been bent to form a sharper acute angle with the riser 114. The length of tab 102 from bend 101 to edge 103, and the angle that the tab 102 makes with the riser 114 are selected such that the edge 103 is spaced above the base 112 by a distance less than three times the thickness of lip 19 located at the front of decorative element 15. The lip 19 is slipped under edge 103 and pushed toward the riser 114. This decreases the angle between the tab 102 and riser 114 and moves the edge 103 closer to base 112 thereby pinching the lip 19 between edge 103 and base 112, and securing the front edge 18 of panel 14 therebetween. The front edge of the panel 14 is thus restrained from lifting even in relatively high winds.

While the invention has been described with reference to FIGS. 1 through 12 and the three embodiments of clips shown therein, the Figures are intended only for the purposes of illustration and should not be interpreted as limitations upon the invention. It is to be understood that many changes, alterations, substitutions and changes in material and in relationships could be made by one of ordinary skill in the art without departing from the spirit and scope of the invention as set forth in the appended claims.

What is claimed:

1. A roof covering system including a roofing panel having decorative elements, and configured for coupling to similar roofing panels when installed, comprising:

(a) a unitary panel having a background sheet having a front edge, a rear edge, a first side edge and a second side edge;

a decorative element means extending from said background sheet and having first and second ends, said first end adjacent said front edge of said sheet and said second end adjacent said rear edge of said sheet, said rear edge of said background sheet extending rearward of said second end of said decorative element means to define a nailing flange therebetween coverable, at least in substantial part, by a similar adjacent panel;

first means for coupling adjacent said first end;

second means for coupling adjacent said rear edge; and (b) unitary joining means configured at one end for cooperative engagement with said first means for coupling and configured at its other end for cooperative engagement with said second means for coupling;

whereby said panel may be fastened in place through said nailing flange and coupled, adjacent both its front and rear edges, to similar roofing panels in adjacent courses.

2. The roof covering system according to claim 1 wherein said joining means, when installed to couple adjacent panels, has said one end proximate said second end of said decorative element means and coupled to said first means for coupling of an adjacent panel, and has said other end coupled to said second means for coupling whereby said second means for coupling and said other end of said joining means are overlapped and hidden from view beneath the first end of a decorative element means on an adjacent panel.

3. The roof covering system according to claim 1 wherein said first means for coupling comprises a slot provided in said first end of said decorative element means.

4. The roof covering system according to claim 3 wherein said slot is arcuate.

5. The roof covering system according to claim 3 wherein said slot is straight.

6. The roof covering system according to claim 3 wherein said slot is round.

7. The roof covering system according to claim 1 wherein said first means for coupling comprises a lip formed in said front edge of said background sheet.

8. The roof covering system according to claim 1 wherein said second means for coupling comprises a raised surface area projecting above said background sheet.

9. The roof covering system according to claim 8 wherein said raised surface area projects above said background sheet a distance approximately equal to the thickness of said background sheet.

10. The roof covering system according to claim 1 wherein said second means for coupling is located along said rear edge directly behind said second end of said decorative element means.

11. The roof covering system according to claim 1 wherein said one end of said joining means is configured to provide a base, a riser and a tab;

said riser extending upwardly from one end of said base;

said tab extending rearwardly from the top of said riser toward said other end of said joining means, said riser and said base disposed adjacent portions of said decorative element means, said tab adapted to engage said second means for coupling.

12. The roof covering system according to claim 11 wherein said tab is bent toward said base to form an acute angle with said riser.

13. The roof covering system according to claim 12 wherein the length of said tab and the size of said angle bring the free end of said tab closer to said base then three thicknesses of said background sheet, and said first means for coupling comprises a lip formed on said front edge of said background sheet.

14. The roof covering system according to claim 11 wherein the width of said tab is least at its free end is greatest at a point proximate said tab's junction with said riser.

15. The roof covering system according to claim 14 wherein said tab is provided with two resiliently flexible side wings, each defined by a slot in said tab extending transversely of said tab.

16. The roof covering system according to claim 15 wherein said two side wings are bent to define a generally arcuate tab for cooperation with a first means for coupling comprising a straight slot.

17. The roof covering system according to claim 11 wherein said first means for coupling comprises a round slot.

18. The roof covering system according to claim 1 wherein said first means for coupling comprises an arcuate slot.

19. The roof covering system according to claim 1 wherein said joining means is configured at its other end to provide a U-shaped clip for cooperative engagement with said second means for coupling comprising a raised surface area projecting above said background sheet.

20. The roof covering system of claim 1 wherein said unitary panel is a vacuum formed panel.

21. A roof covering system including a roofing panel having decorative elements, and configured for coupling to similar roofing panels when installed, comprising:

a background sheet having a front edge, a rear edge, a first side edge and a second side edge;

decorative element means extending from said background sheet and having first and second ends, said first end adjacent said front edge of said sheet and said second end adjacent said rear edge of said sheet;

a slot provided in said first end of said decorative element means;

a raised surface area projecting above said background sheet, and provided along the rear edge of said background sheet directly behind said second end of said decorative element means;

a joining means configured at one end to cooperatively engage said slot and configured at its other end to cooperatively engage said raised surface whereby said roofing panel may be coupled to similar roofing panels.

22. The roof covering system according to claim 21 wherein:

said other end of said joining means is configured to provide a U-shaped section for cooperative engagement with said raised surface area, said raised surface area being slightly thicker than the separation between the arms of the U-shaped section.

23. The roof covering system of claim 21 wherein said roofing panel is a vacuum formed panel.

24. A roofing panel, having at least one decorative element thereon, and configured for coupling to similar roofing panels when installed, comprising:

a background sheet having a front edge, a rear edge, a first side edge and a second side edge;

said at least one decorative element extending from said background sheet and having first and second ends, said first end adjacent said front edge of said sheet and said second end adjacent said rear edge of said sheet;

a slot provided in said first end of said at least one decorative element;

a raised surface area projecting above said background sheet a distance approximately equal to the thickness of said background sheet, said raised surface area being located along said rear edge of said background sheet and directly behind said second end of said at least one decorative element;

joining means configured at one end to slide under said raised surface area to be retained thereby and configured at the other end for cooperative engagement in a slot in a similar panel;

whereby the first end of said at least one decorative element is adapted to be coupled to the rear edge of a similar roofing panel and said rear edge of said background sheet is adapted to be coupled to the first end of another such similar roofing panel.

25. A roof covering system including a roofing panel having decorative elements, and configured for coupling to similar roofing panels when installed, comprising:

a background sheet having a front edge, a rear edge, a first side edge and a second side edge;

decorative element means extending from said background sheet and having first and second ends, said first end adjacent said front edge of said sheet and said second end adjacent said rear edge of said sheet;

first means for coupling in the form of a round slot provided adjacent said first end;

second means for coupling provided to said rear edge proximate said second end;

joining means configured at one end for cooperative engagement with said first means for coupling and configured at its other end for cooperative engagement with said second means for coupling;

said one end of said joining means being configured to provide a base, a riser and a tab, said riser extending upwardly from one end of said base, said tab extending rearwardly from the top of said riser tooward said other end of said joining means, said tab having four arms defining a cross-shape, whereby two of said arms have ends which with said round slot interlock;

whereby said panel may be coupled, at both its front and rear edges, to similar roofing panels.

26. The roof covering system of claim 25 wherein said roofing panel is a vacuum formed panel.

* * * * *